US005541719A

United States Patent [19]

Tamaki

[11] Patent Number: 5,541,719

[45] Date of Patent: Jul. 30, 1996

[54] FIXING DEVICE HAVING CONDUCTIVE FIXING FILM IN IMAGE FORMING APPARATUS

[75] Inventor: Syunpei Tamaki, Hadano, Japan

[73] Assignee: Ricoh Company, Ltd., Tokyo, Japan

[21] Appl. No.: 266,681

[22] Filed: Jun. 28, 1994

[30] Foreign Application Priority Data

Jun. 28, 1993 [JP] Japan ..... 5-157647

[51] Int. Cl.[6] ..... G03G 15/20

[52] U.S. Cl. ..... 355/285; 219/216; 355/203; 355/289

[58] Field of Search ..... 355/285, 282, 355/289, 290, 206, 203; 219/216, 469, 471

[56] References Cited

U.S. PATENT DOCUMENTS

| | | | |
|---|---|---|---|
| 4,998,121 | 3/1991 | Koh et al. | 347/156 |
| 5,182,606 | 1/1993 | Yamamoto et al. | 355/289 |
| 5,287,154 | 2/1994 | Nakai et al. | 355/285 |
| 5,300,999 | 4/1994 | Koh et al. | 355/289 |
| 5,367,369 | '11/1994 | Nakai et al. | 355/285 |

*Primary Examiner*—A. T. Grimley
*Assistant Examiner*—Thu Dang
*Attorney, Agent, or Firm*—Oblon, Spivak, McClelland, Maier & Neustadt

[57] ABSTRACT

An image fixing apparatus includes a conductive fixing film, a pair of electrodes contacting the conductive fixing film, a supporting element supporting the electrodes, a pressing roller located on a side of the conductive fixing film opposite to the supporting element and having an outer elastic layer. The conductive fixing film is moved at a constant speed so that a transfer material having an unfixed toner image is nipped between the conductive fixing film and is moved. The transfer material is thus subjected to a heating and fixing operation. A thermometer detects a temperature of the electrode or one part of the supporting element. A memory stores a data-table having a relation between a power supply to the electrodes and a temperature of the thermometer. A control circuit both determines a suitable supply power from the data-table and the temperature detected by the thermometer, and controls the supply power supplied to the electrodes.

5 Claims, 5 Drawing Sheets

FIXING DEVICE HAVING CONDUCTIVE FIXING FILM IN IMAGE FORMING APPARATUS

BACKGROUND OF THE INVENTION

1. Field of the Invention

The present invention generally relates to image forming apparatuses for use in copiers, facsimiles, printers, and the like, and more particularly to a xerographic image processing apparatus having an image fixing apparatus for heating and fixing a toner image formed on a recording material.

2. Description of the Related Art

Most of the conventional fixing apparatuses for a xerographic image processing apparatus are of a heat roller type. The heat roller fixing apparatus includes a heating roller maintained at a predetermined temperature and a pressing roller having an elastic layer and press-contacted to the heating roller. A transfer material, for example paper which has an unfixed toner image thereon, is passed through a nip between the heat roller and the pressing roller and heated to fix the image. In this type of image fixing apparatus, there is a problem due to the so-called toner offset phenomenon. That is, toner undesirably transfers to the heating roller. In order to prevent the toner offset phenomenon, the temperature of the heating roller has to be maintained at an optimum level. This requires a large thermal capacity for the heating roller or a heating material. The large thermal capacity necessitates a longer period of time to increase the temperature of the heating roller to the predetermined level, thereby requiring a longer waiting time upon start of the apparatus.

In order to prevent the above mentioned problems, the following types of fixing apparatus have been proposed:

1) A fixing apparatus heating intensively a transfer material through a fixing film (Japanese Laid-Open patent Application No. 63-313182), 2) A fixing apparatus having an electrically conductive, self-heating (resistance) film as the fixing film (called a conductive fixing film for short hereinafter), and heating a transfer material (Japanese Laid-Open Patent Application No. 3-144676).

FIG. 12 shows a conventional fixing apparatus having said conductive fixing film for use in a xerographic image processing apparatus.

Referring to FIG. 12, the fixing apparatus comprises a pair of electrodes 1*d*, a support element la supporting the electrodes 1*d*, a conductive fixing film 1*b* moving while in contact with a surface of the support element, and a pressing roller 1*c* located just opposite to the support element 1*a*. A transfer material 1*h* having an unfixed toner image 1*e* thereon and the conductive fixing film 1*b* are passed through a nip between the support element 1*a* and the pressing roller 1*c*.

There are two ways to move the conductive fixing film 1*b*. One way is shown in FIG. 13. Referring to FIG. 13, this type of fixing device employs an endless belt as the conductive fixing film. The film is driven by a driving roller 1*f* and is tensioned by the driving roller and a follower roller 1*g*. The other type is not shown in the Figures. This type (called non-endless belt type) of a fixing device employs a film take-up shaft. The film that has been wound on a feeding shaft is transferred or wound up on the film take-up shaft. Neither type of fixing device has been commercialized yet.

In the fixing device that employs the conductive fixing film, a long period of time is not required to increase the temperature of the heating element to the predetermined level. On the other hand, the temperature of the film as a heating element that directly contacts the transfer material cannot be constantly controlled. Because the film itself is moving during fixing, the temperature of the film itself cannot be detected. Consequently, the temperature of the conductive fixing film sometimes becomes too high, so that the electricity consumption is much greater, and which reduces the durability of the conductive fixing film.

SUMMARY OF THE INVENTION

Accordingly, it is an object of the present invention to provide a novel and useful image fixing apparatus wherein the aforementioned problems are eliminated.

Another object of the present invention is to provide an image fixing apparatus wherein suitable electric power can be supplied to the conductive fixing film and good fixing quality can be obtained.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Hereinafter, the xerographic image processing apparatus having an image fixing apparatus of the present invention will be described with reference to the drawings.

Figure 1:
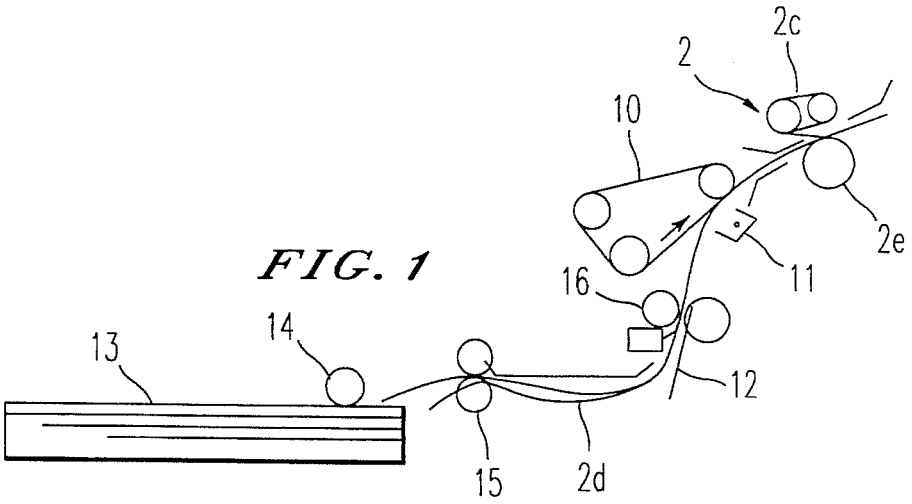
FIG. 1 is a sectional view of an image forming apparatus according to an embodiment of the present invention.

FIG. 1 shows an image processing apparatus according to an embodiment of the present invention. Referring to FIG. 1, there are mainly shown a paper transfer passage and devices around the passage. Reference number 2 denotes an image fixing device. Numeral 10 denotes a photosensitive belt. Numeral 11 denotes a transfer charger. Numeral 12 denotes a register sensor. Numeral 13 denotes a paper cassette. Numeral 14 denotes a pick-up roller. Numeral 15 denotes a pair of conveying rollers. Numeral 16 denotes a pair of register rollers.

The photosensitive belt 10 rotates in the direction indicated by an arrow. The charger (not shown) is effective to uniformly charge the photosensitive belt 10. The belt 10 is exposed to a laser light image by an exposure device (not shown), so that an electrostatic latent image is made visible by the developer (not shown) using toner. The transfer material 2*d* is fed from the paper cassette 13 to the photosensitive belt 10 by a pick-up roller 14 through the pair of conveying rollers 15 and the pair of register rollers 16. The toner image formed on the photosensitive belt 10 is transferred onto the transfer material 2*d* by the transfer charger 11. Then the transfer material 2*d* is introduced into an image fixing device 2 where the transfer material 2*d* is subjected to a heating (Joule heating) and fixing operation. Subsequently, the transfer material is discharged to a discharge tray (not shown). After the image transfer, the residual toner remaining on the photosensitive belt 10 is removed by a cleaner (not shown).

Figure 2:
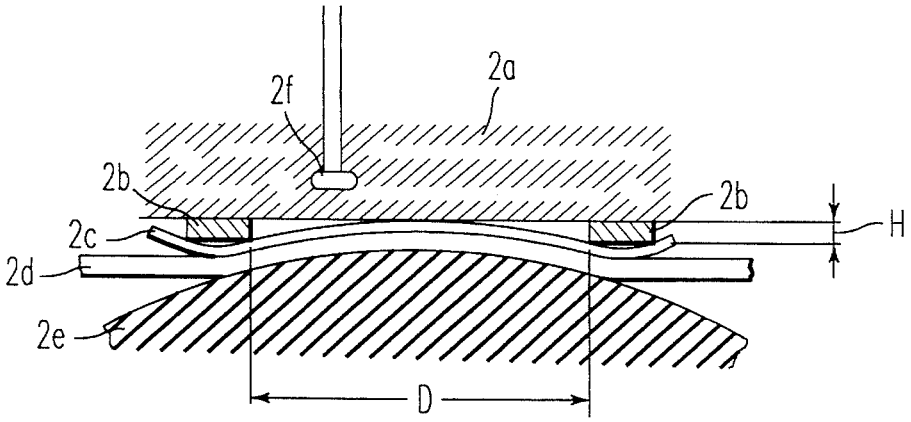
FIG. 2 is an enlarged sectional view of an image fixing apparatus used in the image forming apparatus of FIG. 1.
Figure 13:
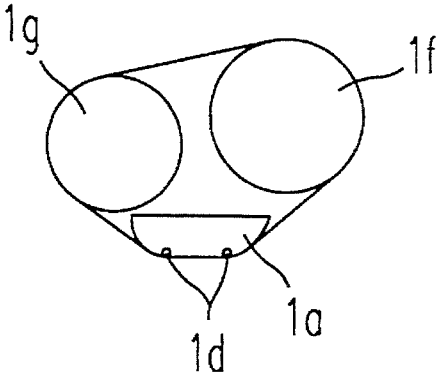
FIG. 13 is a view showing a fixing apparatus that employs an endless belt as the conductive fixing film.

FIG. 2 is an enlarged sectional view of the fixing apparatus 2 in FIG. 1. Referring to FIG. 2, the fixing apparatus comprises a pair of electrodes 2*b*, a support element 2*a* supporting the electrodes 2*b*, a conductive fixing film 2*c* moving while in contact with a surface of the support element, a pressing roller 2*e* located just opposite to the support element 2*a*, and a thermometer 2*f*. The conductive fixing film 2*c* and a transfer material 2*d* having an unfixed toner image thereon are passed through a nip between the support element 2*a* and the pressing roller 2*e*. The pressing roller 2*e* has an outer elastic layer made of silicone rubber or the like. The thermometer 2*f* is embedded in the support element 2*a* or adheres to a back surface of the support element 2*a*. In this embodiment a thermistor is used as the thermometer. The fixing device of this embodiment employs an endless belt as the conductive fixing film, as shown in FIG. 13.

The electrodes 2*b*, the support element 2*a*, and a reinforcing plate (not shown in the FIG. 1) on the back surface of the support element are hereinafter called a head. The material of the fixing film 2*c* is polyamide including carbon. The film is formed with a thickness of 20 microns, a length of 190 mm and a width of 270 mm, for example. A sheet electrical resistance of the film is 2000 $\Omega/cm^2$. A length D in FIG. 2 is 1 mm and a height H is 10 μm~30 μm. The electrode 2*b* has a length of 267 mm at a right angle to FIG. 2.

When a power supply (not shown) supplies electric power to the two electrodes, the conductive fixing film 2*c* between the electrodes 2*b* (having a length D in FIG. 2) is charged with an electrical current since the surface of the ceramic support element 2*a* is non-electrically conductive. Then the conductive fixing film is self-heated due to its electrical resistance.

As mentioned above, the image processing apparatus has a register sensor 12. The sensor 12 is provided to determine a time when the transfer material is to be fed so as to be synchronized with the image on the photosensitive belt 10. When the sensor 12 detects a tip of the transfer material 2*d*, it starts to count up a predetermined time, and the photosensitive belt 10 starts to be exposed to the laser light image, so that the image can be positioned at a predetermined appropriate position on the transfer material 2*d*.

In the following embodiments of this invention, the register sensor 12 is also used as a sensor to detect the timing for when the transfer material 2*d* arrives at the fixing device. In more detail, when the sensor 12 detects the tip of the material 2*d*, it starts to count up a predetermined time to when the material 2*d* arrives at the fixing device. Of course, instead of the sensor 12, a mechanical sensor, for example, may be mounted on the fixing device. Both a hardware-type timer and a software-type timer may be employed as a means for counting the predetermined time instead of the sensor 12.

Figure 3:
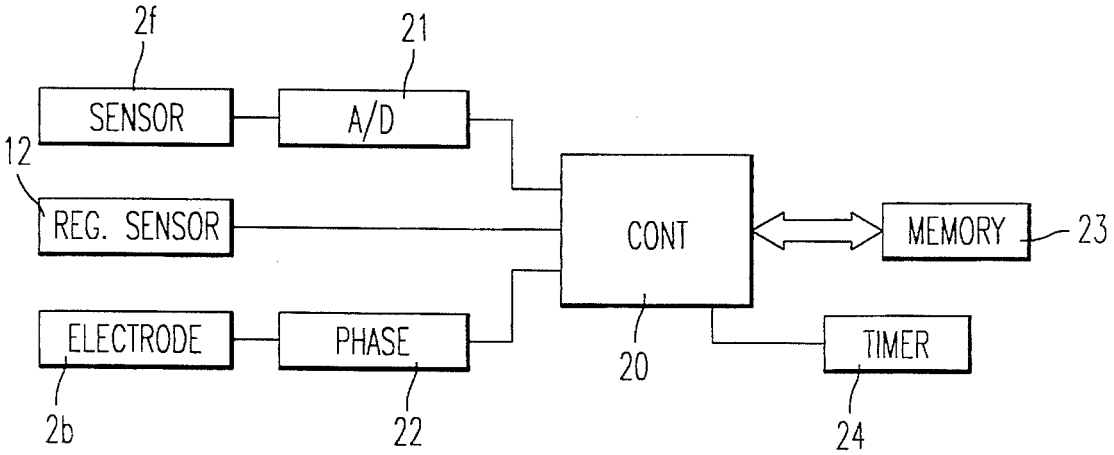
FIG. 3 is a block diagram illustrating a control system of an apparatus of FIG. 1.
Figure 4:
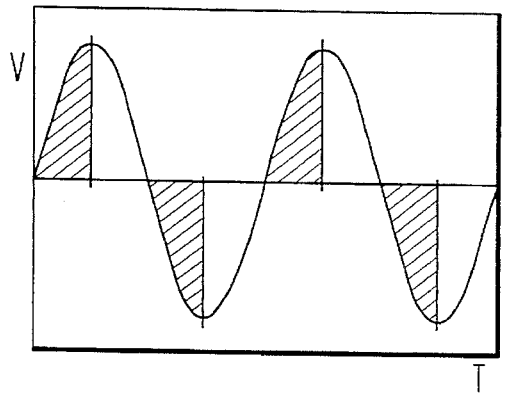
FIG. 4 is a graph explaining how to control an effective amount of DC power (P) is controlled over time by the phase controller of FIG. 3.

FIG. 3 is a block diagram illustrating a control system of the fixing device according to an embodiment of the present invention. The thermometer 2*f* is connected to a control circuit 20 via an A/D converter 21. An output signal of the thermometer 2*f* is converted from analog signals to digital signals by the A/D converter 21. The register sensor 12 is also connected to the control circuit 20. The electrodes 2*b* of the fixing device are connected to a control circuit via a phase controller 22. The power supply from a power source to the electrode 2*b* is controlled by the control circuit 20 via the phase controller 22. The power supply is in the form of a pulse wave having a period of 50 Hz and an amplitude of 100 V(DC). An effective amount of the DC power is controlled by the phase controller 22 as shown in FIG. 4. Power is supplied to the electrodes 2*b* only when the transfer material is at the fixing device.

The control circuit 20 comprises a well-known microcomputer, well-known memories, well-known counters, and other kinds of well-known circuits. The control circuit 20 controls not only the fixing device but also the other devices of the image processing apparatus, so that there are many kinds of programs and data-tables in the memories of the control circuit 20. An additional memory 23, like an IC card or a RAM board, and a timer 24 are connected to the control circuit 20. In the memory 23, there are stored information relating to a detected temperature by the thermometer 2*f* and control information. The effective amount of DC power to the electrodes 2*b* of the fixing device is decided as follows.

A description will now be given of a first embodiment of the present invention with reference to FIG. 5 and FIG. 6.

A ceramic base having a thickness of 0.6 mm is used as the support element 2*a* in this embodiment. The thermometer 2*f* is attached to the back side of the support element 2*a*. A moving speed of the transfer material 2*d* is set to 30 mm/sec. A single component toner is used as the toner on the transfer material. FIG. 5 is a graph showing temperature changes over time while a constant power is supplied to the electrodes 2*b*. The temperatures of the graph have been calculated by a method of heat conduction analysis. Referring to FIG. 5, a solid line F shows the temperature of the surface of the conductive fixing film 2*c* near to the electrode 2b. A dotted line S in FIG. 5 shows the temperature of the surface of the support element 2a which contacts to the film 2c. And a chain line Th in FIG. 5 shows a temperature detected by the thermometer 2f. According to the graph of FIG. 5, the temperature of the support element (the dotted line) is similar or close to the temperature Th of the thermometer. Using FIG. 5, the power supply to the conductive fixing film can be decided on the basis of the temperature of the thermometer. The details are as follows.

The area D (a nip area) of the conductive fixing film in FIG. 2 is electrically energized and begins to self heat. Theoretically, the rate of increase of the temperature of the film 2c is almost entirely determined by the temperature of the back surface of the transfer material which contacts the film 2c and the temperature of the surface of the head which contacts the film 2c, assuming a constant power supply. The transfer material 2d is transferred to the nip area D at room temperature. The thermal capacity of the conductive fixing film 2c is much smaller than the thermal capacity of the transfer material 2d. Consequently, the rate of increase of the temperature of the film 2c is mainly determined by the temperature of the surface of the head which contacts the film 2c. The rate of increase of the temperature of the film 2c in the nip area D determines the amount of heat supplied to the surface of the transfer material. In other words, the rate of increase of the temperature of the film 2c in the nip D can be kept constant if the correct temperature of the surface of the head can be constantly detected and the electric power supplied according to the detected temperature. This is very important in this type of the fixing apparatus, because too high a temperature of the film causes poor endurance of the film.

Figure 5:
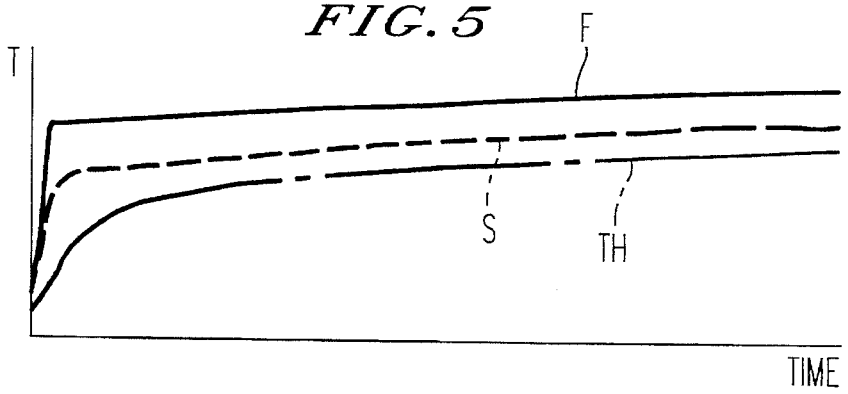
FIG. 5 is a graph showing temperature (T) changes over time in the conductive fixing film (F), the support element (S), and the thermometer (Th) according to a first embodiment of the present invention.

As said before, according to the graph of FIG. 5, the temperature of the support element (the dotted line) is similar or close to the temperature of the thermometer (the chain line). Any difference between the two temperatures becomes very small in a short time right after the electric power starts to be supplied because a ceramic is used as a material for the head. The ceramic is a highly heat conductive material and so there is almost no temperature difference inside the head. Actually it takes only a few micro seconds to overcome the small difference between the two temperatures, so that it can be thought of as a warm-up time and be neglected. And as the temperature difference between the two temperatures is only less than one degree, the thermometer temperature can be considered as the head-surface temperature which contacts the film. Consequently, the electric power is determined by the temperature determined by the thermometer.

Figure 6:
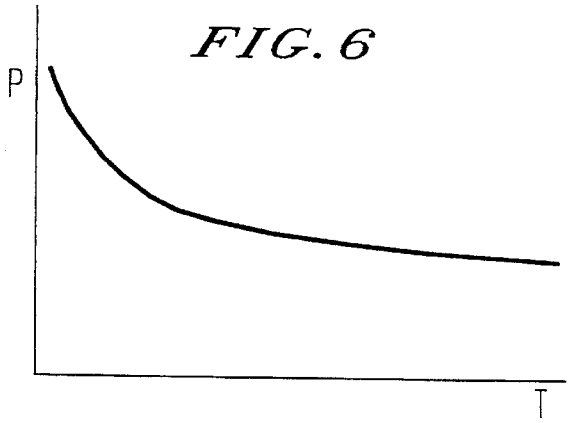
FIG. 6 is a graph showing a power supply (P) change for various temperatures (T) of a support element in order to keep a constant rate of increase of the temperature of the conductive fixing film.

FIG. 6 is a graph showing a power supply required at various temperatures of a support element in order to keep a constant rate of increase of the temperature of the conductive fixing film. The graph information is modified as a data-table and memorized to the memory 23 in FIG. 3.

When the output signal of the thermometer 2f is outputted to the control circuit 20 via the A/D converter 21, a suitable effective electric power is selected or determined from the data-table according to FIG. 6 in the memory 23. And the control circuit instructs the phase controller 22 to control the electric power supplied to the electrodes 2b.

This embodiment has been experimentally found to be useful for relatively low speed transfer material. Suitable electric power can be supplied to the conductive fixing film and good fixing can be obtained.

A description will now be given of a second embodiment of the present invention. In this embodiment, a transfer speed of the transfer material 2d is set to 60 mm/sec, which is twice that in the first embodiment. The material of the support element 2a is polyamide having a 2 mm thickness. The thermometer 2f is embedded in the support element 2a by a 1 mm depth from the surface of the element 2a which contacts the conductive fixing film 2c. In this embodiment, the film 2c must be kept at a higher temperature than that of the first embodiment, and the transfer material 2d requires a much greater quantity of heat per second than that of the first embodiment, because the transfer material 2d of the second embodiment is moved faster than that of the first one. Consequently, a low thermal efficiency and heat-resistant resin, such as a polyamide-type resin, is employed as the material of the support element 2a to minimize heat loss.

Figure 7:
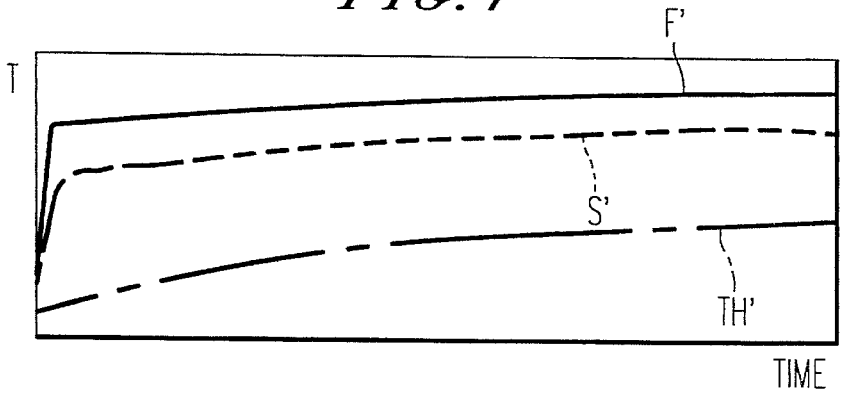
FIG. 7 is a graph showing temperature (T) changes in the conductive fixing film (F'), the support element (S'), and the thermometer (Th') according to the second embodiment of the present invention.

FIG. 7 is a graph showing the temperature change in the conductive fixing film, the surface of the support element, and the thermometer according to the second embodiment. According to the graph, there is a much greater difference between the temperature of the surface of the support element and the temperature of the thermometer than in the first embodiment. The environment temperature has a great influence on the temperature of the thermometer, but it has a small influence on the temperature of the conductive fixing film. Consequently, in this second embodiment the power to be supplied cannot be determined by the temperature of the thermometer as in said first embodiment. It is possible to determine the supply power by using a data-table like FIG. 6 for every environment temperature by use of an additional thermometer to detect the environment temperature. But this will increase the cost. If a kind of ceramic, like alumina, is employed as the support element 2a instead of the above mentioned resin, there would be no temperature difference as in FIG. 7. But a big electric power source would be necessary to supply the power to the fixing film, because much of heat would leak through the ceramic material.

Figure 9:
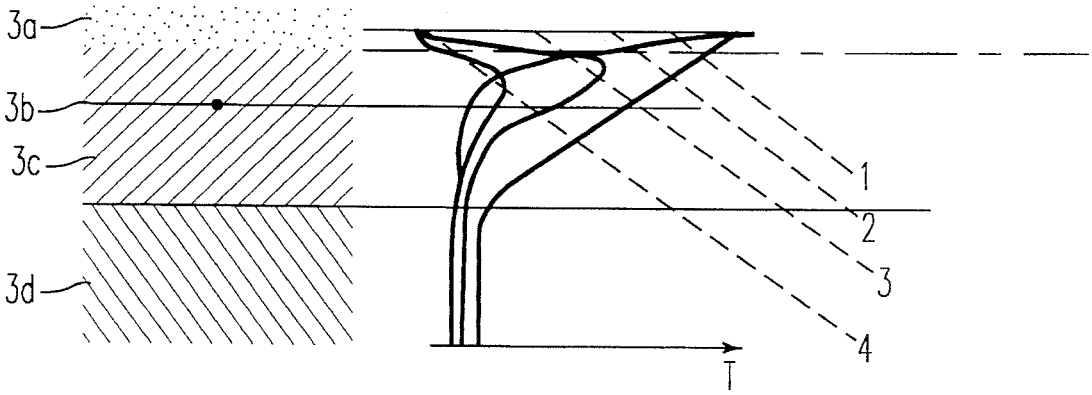
FIG. 9 is a view showing a structure of a conductive fixing film, a support element and a reinforcing plate, and graphs of temperatures (T) in various parts of said structure in the second embodiment.

Before a further detailed description is made of the second embodiment, a temperature change or a temperature distribution inside the head in this second embodiment will be briefly explained. FIG. 9 schematically shows the structure of the head and graphs of the temperatures in various parts of the structure at various times. In FIG. 9, elements 3a to 3d are, respectively, the film 3a, the thermometer 3b, the support element 3c and a reinforcing plate 3d. Also, in FIG. 9, a graph line (1) shows a temperature state of the head after the temperature distribution reaches a normal status. A graph line (2) shows a temperature state when the electric power is started to be supplied. A graph line (3) shows a temperature state just after the electric power is stopped. As a silicon outer surface layer of the pressing roller (not shown in FIG. 9) is contacting to the surface of the film 3a, the heat of the film also leaks to the silicon layer. A graph line (4) shows a temperature state after the electric power has not been supplied for a long time.

According to the graph lines (1) and (2), when electric power is supplied to the film, there is a big temperature difference between the surface of the support element 3c and the thermometer 3b. Just after the electric power is stopped, the temperature state is as shown by the graph line (3). The graph line (3) will change to the graph line (4) over time (a few seconds, depending on other conditions). In the graph line (3) the temperature distribution is uneven. But in the graph line (4) the temperature distribution becomes almost uniform. Consequently, in this embodiment, the supply power cannot be determined by the temperature of the thermometer as in the first embodiment since there will not be sufficient time for the head temperature state to reach that of graph line (4) and become almost even.

In this embodiment, the supply power to the electrodes is determined by an early temperature of the conductive fixing film. The early temperature is a temperature detected by the thermometer 3*b* when a tip of the transfer material has reached the fixing apparatus. The temperature of the conductive fixing film while the electric power is supplied mainly depends on this early temperature. But the early temperature is not useful for determining power when the temperature distribution in the head corresponds to the graph line (3) because the temperature distribution there is not even. Therefore, for high speed operation where the temperature distribution in the head corresponds to graph line (3), an imaginary early temperature as detailed later is necessary instead of the actual early temperature.

A description will now be given, with reference to FIG. 11, of a way to determine the status of the graph line (3) or the status of the graph line (4). While the transfer material is moved to the fixing device, the electric power is being supplied to the film, so that the temperature of the thermometer is increasing at an even pace. On the other hand, while the transfer material is not moved to the fixing device, the electric power is not being supplied to the film, so that the temperature is decreasing at an even pace. Consequently, when a differential of the temperature of the thermometer by time is a positive number, it means that the power is being supplied. But when the differential is a negative number, it means that the power is not being supplied. According to experiment, it takes about 7 seconds at most for the temperature distribution in the head to become uniform.

Figure 8:
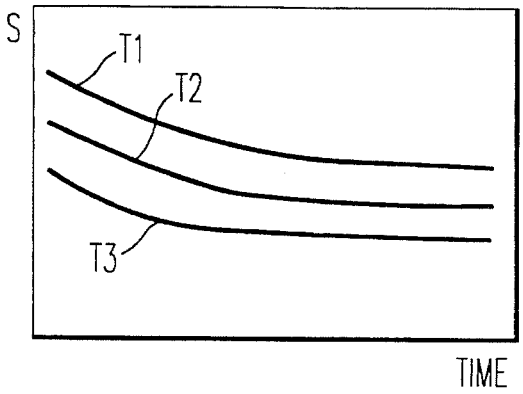
FIG. 8 is a graph of the DC power supply (S) vs. power supply timing (Time) for the electrodes for various first temperatures that are detected when a tip of the transfer material starts to go through the fixing device in the second embodiment.
Figure 10:
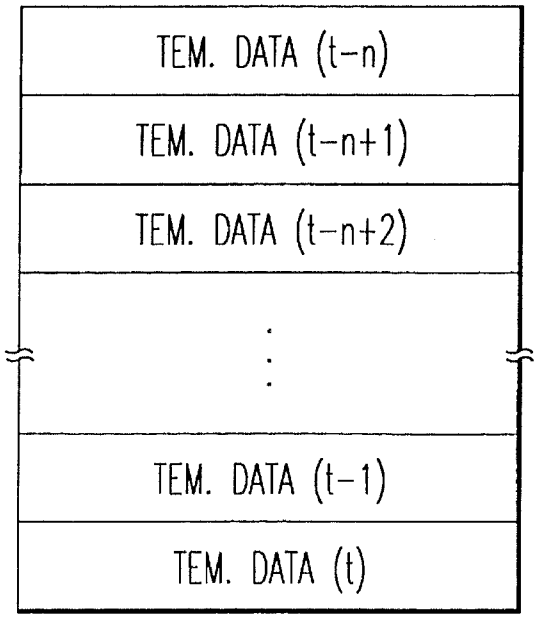
FIG. 10 is a data-table of temperatures from a past(t-n) time to a present(t) time.
Figure 12:
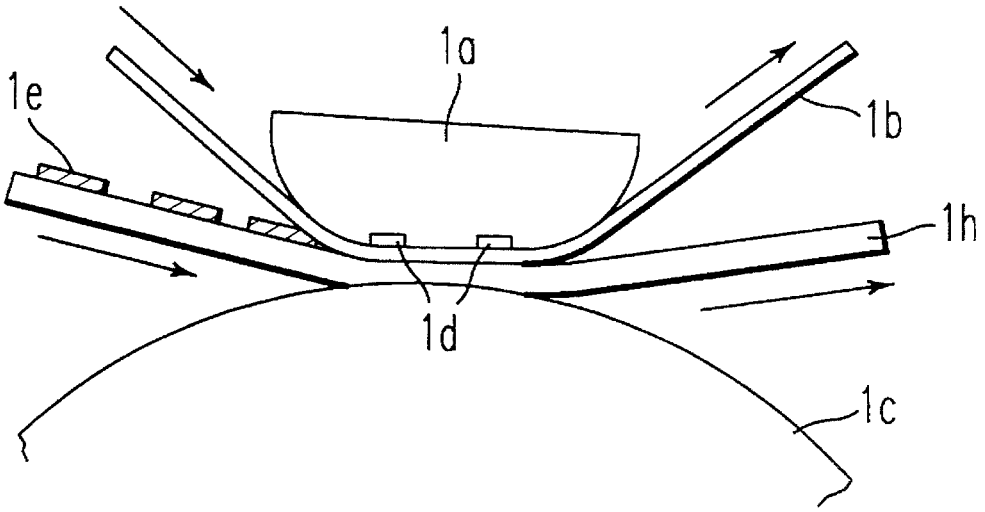
FIG. 12 is a sectional view of a conventional fixing apparatus, having the conductive fixing film, for use in a xerographic image processing apparatus.

When the temperature distribution in the head becomes uniform, as mentioned before, the power is controlled by the early temperature of the thermometer. FIG. 8 is a graph showing the power supply vs. power supply timing to the film at various early temperatures. In FIG. 8, three graphs corresponding to the three early temperatures (T1, T2, T3) are shown. The temperatures (T1, T2, T3) are, for example, 10° C., 25° C., 40° C. The graph information is modified to be data-table information and is memorized to the memory 23, for example in the format shown in FIG. 10.

When the transfer material reaches the fixing apparatus, the early temperature is detected by the thermometer 2*f*. The data-table most closely corresponding to the detected early temperature is picked up among the data-tables of the memory 23. The electric power supplied to the film is determined and controlled according to the data-table. This has experimentally been found to be accurate. Suitable electric power can be supplied to the conductive fixing film and good fixing can be obtained. In this embodiment, only three data-tables for the early temperatures are shown, but more data-tables may be memorized, as necessary.

In this embodiment, as said before, the register sensor 12 is also used for a sensor to detect a timing that the transfer material 2*d* has arrived at the fixing device. In more detail, when the sensor 12 detects the tip of the material 2*d*, it starts to count up a predetermined time for indicating that the material 2*d* has arrived at the fixing device. A time when it has finished counting up the predetermined time is regarded as a time when the transfer material has reached the fixing device. A time is also counted by timer 24 after the transfer material has reached the fixing device.

A description will now be given of the imaginary early temperature used when the temperature distribution in the head is uneven. In this case, the transfer material arrives at the fixing device before the temperature distribution inside the head becomes even. This may happen in an image processing device that has a high speed data-handling system. In this situation, the early temperature cannot be used, because the early temperature is different from the temperature of the surface of the head. The imaginary early temperature is determined as follows:

First, the approximate temperature of the reinforcing plate 3*d* at a time just after the transfer material has been almost discharged from the fixing device is determined. When the transfer material is about to be discharged, the power supply almost reaches an even level, so that the temperature in the head has reached a certain level. For example, the surface temperature of the fixing film reaches a constant level (170° C.) when the temperature of the fixing film is 180° C.–190° C. In this condition, the temperature of the reinforcing plate is as follows:

$$170-(170-Tm)\times 2=2\times Tm-170 \quad (1)$$

According to experiment, the temperature of the reinforcing plate actually ranges from room temperature to about 50° C. A heat capacity of the reinforcing plate is much more than that of the support element, so that the temperature of the reinforcing plate decreases less than the temperature of the thermometer after the power supply has been stopped. It falls only a few degree in about 10 seconds or so. On the other hand, the temperature of the thermometer decreases rapidly and it depends mainly the temperature of the support plate. An approximate ratio of the decrease of the temperature of the thermometer to that of the support plate is determined by the following formula:

$$(T-Tm)/m=f(Tm,\ Tdm,\ Td) \quad (2)$$

Where T:

a temperature of the thermometer when the next material has come to the fixing device, Tm: a temperature of the thermometer when the former material has just been discharged (power has just stopped), Td: a temperature of the reinforcing plate when the next material has come to the fixing device, Tdm: a temperature of the reinforcing plate when the former material has just been discharged (power has just been stopped).

If a change of the temperature of the reinforcing plate over time is neglected, the temperature (Td) is determined from the above formula (1). Otherwise, the temperature is determined from the formula (1) and (2). The following formula may be used instead of the formula (2):

$$(T-Tm)/m=A\times(T+Tm-2\times Td) \quad (3)$$

Then an imaginary early temperature is calculated and determined from the temperature of the thermometer and the temperature of the reinforcing plate. The imaginary early temperature is used instead of the actual early temperature so that the data-table corresponding to the imaginary early temperature among the data-tables of the memory 23 is used. The electric power supplied to the film is determined and controlled according to the data-table. This embodiment is useful for transfer material moving at high speed and where there is a short interval between the transfer materials, as in a high speed data-handling system.

Figure 11:
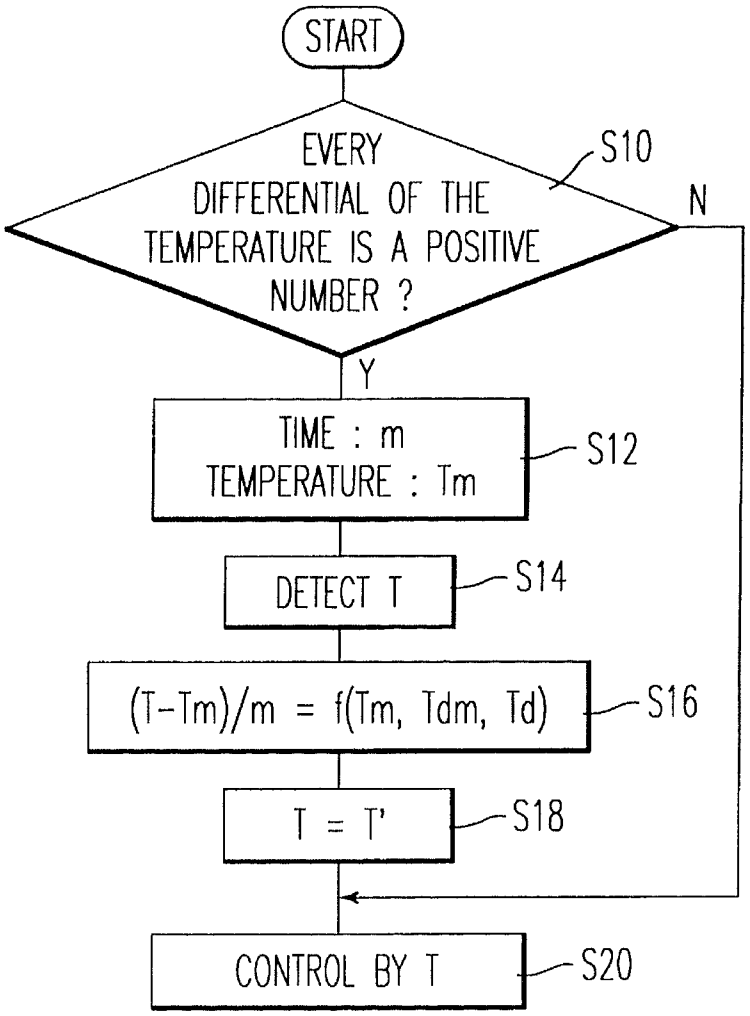
FIG. 11 is a flow chart illustrating operation of the apparatus according to the second embodiment.

FIG. 11 shows a flow chart illustrating an operation of the above embodiment. In a first step S10, it is determined whether the temperature differential is positive or negative. If positive, it means that power is being supplied, and so the head temperature is uneven, requiring the use of the imaginary early temperature. Control therefore proceeds to step S12 where the temperature Tm at time m is determined, and step S14 where the temperature T is determined. The imaginary temperature T' is then calculated in step S16 and T is set to T' in step S18.

If the result is negative in step S10, control proceeds to step S20 where the actual early temperature is used.

Obviously, numerous modifications and variations of the present invention are possible in light of the above teachings. It is therefore to be understood that within the scope of the appended claims, the invention may be practiced otherwise than as specifically described herein.

What is claimed is:

1. An image fixing apparatus, comprising:

a conductive fixing film formed of a material which self heats when an electrical power is supplied thereto;

a pair of electrodes contacting said conductive fixing film so as to supply electrical power thereto;

a supporting element supporting said electrodes, a surface of said supporting element between said electrodes being non-electrically conductive such that electrical power flows between said electrodes via said conductive fixing film;

a pressing roller, located at a side of said conductive fixing film opposite to said support element and having an outer elastic layer;

means for moving said conductive fixing film at a constant speed, so that a transfer material having an unfixed toner image may be nipped between said conductive fixing film and said pressing roller and be moved so as to be subjected to a heating and fixing operation by heat generated by said conductive fixing film;

a thermometer positioned to detect a temperature of one of said electrodes and a part of said supporting element;

a memory storing a data-table defining a relation between a power supply to said electrodes and a temperature detected by said thermometer; and a control device including means for determining a suitable power supply from said data-table and the temperature detected by the thermometer and for affecting supply of the suitable power to the electrodes.

2. An image fixing apparatus, comprising:

a conductive fixing film formed of a material which self heats when an electrical power is supplied thereto;

a pair of electrodes contacting said conductive fixing film so as to supply electrical power thereto;

a supporting element supporting said electrodes, a surface of said supporting element between said electrodes being non-electrically conductive such that electrical power flows between said electrodes via said conductive fixing film;

a pressing roller, located at a side of said conductive fixing film opposite to said support element and having an outer elastic layer;

means for moving said conductive fixing film at a constant speed, so that a transfer material having an unfixed toner image may be nipped between said conductive fixing film and said pressing roller and be moved so as to be subjected to a heating and fixing operation by heat generated by said conductive fixing film;

a thermometer positioned to detect a temperature of one of said electrodes and a part of said supporting element;

a memory storing control information defining a relation between a power supply to said electrodes and a temperature detected by said thermometer;

a control device including means for determining a suitable power supply from said control information and the temperature detected by the thermometer and for affecting supply of the suitable power to the electrodes; and a timer connected to said control device for timing the supply of the suitable power to the electrodes.

3. An image fixing apparatus, comprising:

a conductive fixing film;

a pair of electrodes contacting said conductive fixing film so as to cause self heating of the conductive fixing film when an electrical power is supplied thereto;

a supporting element supporting said electrodes;

a pressing roller, located at a side of said conductive fixing film opposite to said support element and having an outer elastic layer;

means for moving said conductive fixing film at a constant speed, so that a transfer material having an unfixed toner image may be nipped between said conductive fixing film and said pressing roller and be moved so as to be subjected to a heating and fixing operation by heat from said conductive fixing film;

a thermometer positioned to detect a temperature of one of said electrodes and a part of said supporting element;

a memory storing control information defining a relation between a power supply to said electrodes and a temperature detected by said thermometer;

a control device including means for determining a suitable power supply from said control information and the temperature detected by the thermometer and for affecting supply of the suitable power to the electrodes; and a timer connected to said control device for timing the supply of the suitable power to the electrodes, wherein said memory comprises means for memorizing a temperature detected by said thermometer for a predetermined time, further comprising means for determining said control information based on the memorized temperature and a current temperature.

4. An image fixing apparatus, comprising:

a conductive fixing film;

a pair of electrodes contacting said conductive fixing film so as to cause self heating of the conductive fixing film when an electrical power is supplied thereto;

a supporting element supporting said electrodes;

a pressing roller, located at a side of said conductive fixing film opposite to said support element and having an outer elastic layer;

means for moving said conductive fixing film at a constant speed, so that a transfer material having an unfixed toner image may be nipped between said conductive fixing film and said pressing roller and be moved so as to be subjected to a heating and fixing operation by heat from said conductive fixing film;

a thermometer positioned to detect a temperature of one of said electrodes and a part of said supporting element;

a memory storing control information defining a relation between a power supply to said electrodes and a temperature detected by said thermometer;

a control device including means for determining a suitable power supply from said control information and the temperature detected by the thermometer and for affecting supply of the suitable power to the electrodes; and a timer connected to said control device for timing the supply of the suitable power to the electrodes, wherein said control device includes means for determining an imaginary early temperature of the conductive fixing film.

5. The image forming apparatus according to claim 4 wherein said means for determining an imaginary early temperature of the conductive fixing film includes means for determining a time differential of a temperature detected by said thermometer.

* * * * *